United States Patent [19]

Robbins

[11] Patent Number: 4,932,587

[45] Date of Patent: Jun. 12, 1990

[54] MAILBOX WITH TILTABLE MAIL RETRIEVAL MEANS

[76] Inventor: E. Stanley Robbins, Rte. 6, Box 174, Killen, Ala. 35645

[21] Appl. No.: 398,914

[22] Filed: Aug. 28, 1989

[51] Int. Cl.[5] ..... B65D 91/00

[52] U.S. Cl. ..... 232/17; 232/38

[58] Field of Search ..... 232/17, 19, 38, 24, 232/25, 34

[56] References Cited

U.S. PATENT DOCUMENTS

| | | | |
|---|---|---|---|
| 838,194 | 12/1906 | Lavsh | 232/17 |
| 908,543 | 1/1909 | Brown | 232/34 |
| 1,810,769 | 6/1931 | Jaden | 232/17 X |
| 2,156,858 | 5/1939 | Landis | 232/17 |
| 2,192,445 | 3/1940 | Lau | 232/17 |
| 2,507,785 | 5/1950 | Hartman | 232/19 |
| 4,160,520 | 7/1979 | Cluthe | 232/17 |
| 4,650,113 | 3/1987 | Hunt | 232/17 |

*Primary Examiner*—Robert W. Gibson, Jr.
*Attorney, Agent, or Firm*—Joseph H. Beumer

[57] ABSTRACT

Apparatus that enables easy retrieval of mail from a rural mailbox is disclosed. A horizontally disposed mail-supporting member, which may be the bottom of the box itself or an insertable tray, is arranged to be tilted by pivoting around a transverse axis so that the rear of the member may be placed in an elevated position with respect to the front, thus allowing mail located on the member to slide downward and outward. Mail-catching means in the form of a wall around the periphery of and on the inside of the door holds the mail in position for grasping and keeps it from falling to the ground. A stop means such as a limited-motion hinge is provided to limit downward movement of the door. For the tilting mailbox embodiment, the mailbox is pivotally mounted on a platform so as to allow the entire box to be tilted downward and forward.

15 Claims, 5 Drawing Sheets

MAILBOX WITH TILTABLE MAIL RETRIEVAL MEANS

FIELD OF THE INVENTION

This invention relates generally to mailboxes and particularly to mailboxes having mail retrieval mechanisms.

BACKGROUND OF THE INVENTION

Removal of mail from rural mailboxes presents a problem for the driver of a vehicle in that a long and difficult reach to the back of the box may be required, especially for the larger standard sizes of mailboxes made in accordance with standards of the United States Postal Service. In some instances, the driver may be required to step out of the vehicle to retrieve mail in the back of the box or to pick up mail that falls to the ground owing to dropping the mail because of the awkward position in which his hand and arm are placed in withdrawing the mail.

Various approaches to providing for easier retrieval of mail from mailboxes are disclosed in prior art patents. U.S. Pat. Nos. 4,714,192; 4,121,758; and 3,606,140 disclose use of slidable mail-holding trays that may be pulled forward when the door is opened to bring the mail within reach. Extensible, forwardly-sliding compartments that are nested or telescoped within a mailbox are disclosed in U.S. Pat. Nos. 3,163,356; 2,781,964; and 1,992,640. U.S. Pat. No. 4,160,520 shows a mailbox having a slidable tray within the enclosure and a transverse hinge spaced a considerable distance away from the front of the box. Upon sliding the tray until the hinge reaches the front end of the box, the door and front part of the tray, which is integral with the door, are tiltable downward. Mail located behind the hinge would not be tilted downward, and reaching well back into the box would still be required. The devices disclosed in these patents exhibit disadvantages in their complexity and varying degrees of incompatibility with standard rural mailboxes. It is desired to provide a mailbox or insertable mailbox tray for providing easier access to mail that requires minimized structural changes from standard mailboxes and does not entail sliding of a mail-receiving compartment forward of the door hinge.

SUMMARY OF THE INVENTION

The present invention is directed to a mailbox or insertable tray for a mailbox that includes a mail-supporting surface adapted to be tilted upwardly at the rear of the box or downward at the front when its door is opened so that mail slides forward by gravity out of the box. A mail-receiving tray associated with the door of the mailbox extends diagonally downward when the door is opened and has a side wall for retaining the mail within the tray for grasping. Minimized structural changes to standard mailboxes are required, either for an embodiment where the entire box is mounted to be tiltable or one wherein an insertable tray extending to the rear of the box is made tiltable within the stationary box. In both embodiments, the mailbox door with its associated mail-catching tray and retention wall pivots around a transverse hinge at or near the usual location for the door hinge. No sliding of a tray or compartment forward of the front of the box is required for operation of the invention.

It is, therefore, an object of this invention to provide a mailbox or mailbox insert that projects mail forward into an easily reached container at the front of the box upon opening the mailbox door.

Another object is to provide such a mailbox or insert that requires minimum changes from standard mailbox construction.

Another object is to provide such a mailbox or mailbox insert that does not require sliding of a mail-holding member forward of the mailbox door.

Other objects and advantages of the invention will be apparent from the following detailed description taken in conjunction with the accompanying drawings.

DESCRIPTION OF THE PREFERRED EMBODIMENT

Figure 1:
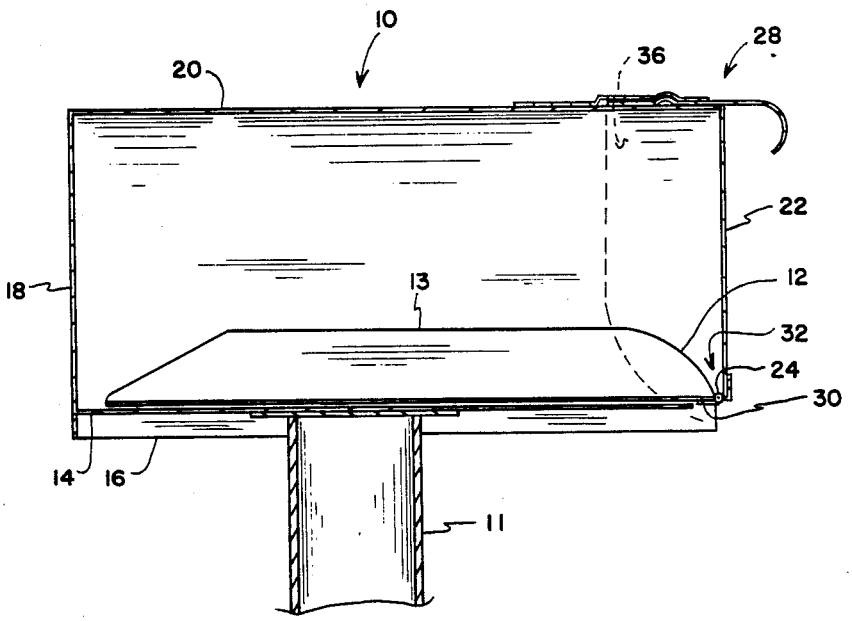
FIG. 1 is a cut-away view of a stationary mailbox having incorporated therein a tiltable tray embodying the invention, the tray being shown in stowed position.
Figure 2:
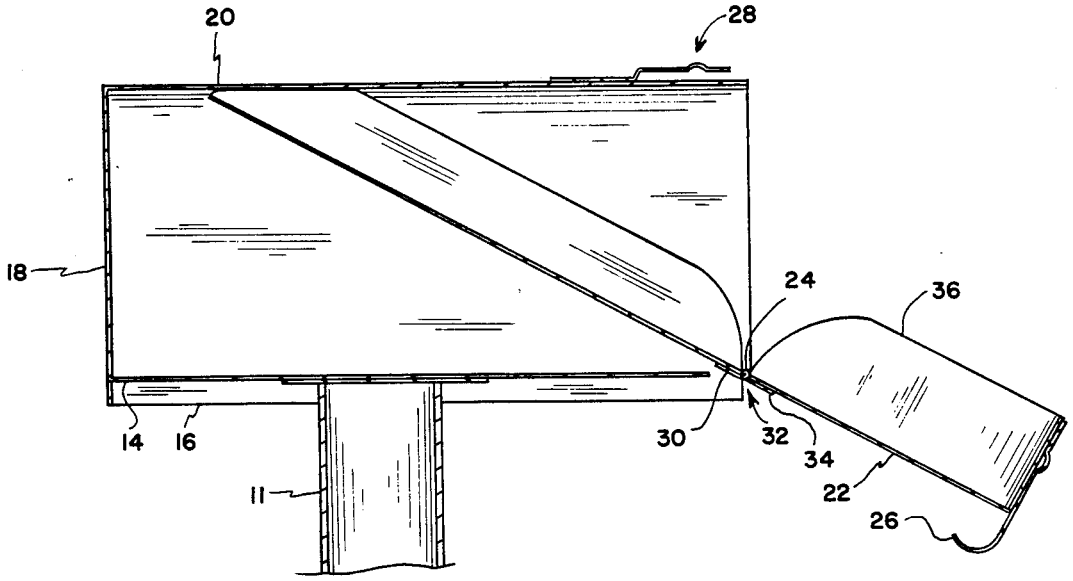
FIG. 2 is a cut-away view of the mailbox and tray of FIG. 1 with the tray shown in deployed position.

Referring to FIGS. 1 and 2, there is shown a conventional mailbox 10 mounted stationary on a post 11. The mailbox is slightly modified to accommodate a tiltable tray 12 embodying the invention. The tray has flanges 13 extending upward from its longer side edges to prevent mail from becoming lodged between the tray and the mailbox sides. Pursuant to conventional construction, the mailbox has a rectangular bottom panel 14 with flange portions 16 projecting downwardly from its edges, a back panel 18 rounded at the top, and a U-shaped roof 20 secured to the bottom panel and back panel, forming the mailbox enclosure. A door 22 is mounted at the front of the box to be moved from closed to open position around a pivot pin 24 that engages apertures near the front edge of the bottom panel. Door 22 has a finger hold or handle 26 near the top which mates with and is secured by a resilient catch 28 when the door is in closed position.

Tray 12 on the top surface of which mail is to be placed conforms generally to the shape of the bottom panel and has its front edge joined to one side 30 of a limited-motion strap or piano-type hinge 32 that pivots around pin 24. The other side 34 of the strap hinge is connected to the front side of door 22 so that the door and tray rotate around the same axis when the door is opened. The door has a mail-retaining wall 36 secured around its periphery perpendicular to the door panel so that mail is retained within the container defined by the door and wall when the tray is deployed as shown in FIG. 2. Tilting of the tray upward at the rear of the box is effected by the hinge when it reaches the limit of its limited motion, hinge side 30 forcing the tray upward when the door is brought downward past the horizontal position. Upon tilting the tray to its raised position, mail supported by the tray readily slides by gravity downward and forward into the mail-catching container, enabling it to be easily grasped for removal.

For the embodiment described above, modifications which would be required to a standard box would include providing the wall for the mail-catching container by attachment to an existing door or replacing the door with one that includes such a wall and providing a hinge as described above that includes a motion-limiting feature or other means such as a stop for engaging the tray when the door is moved fully downward.

Figure 3:
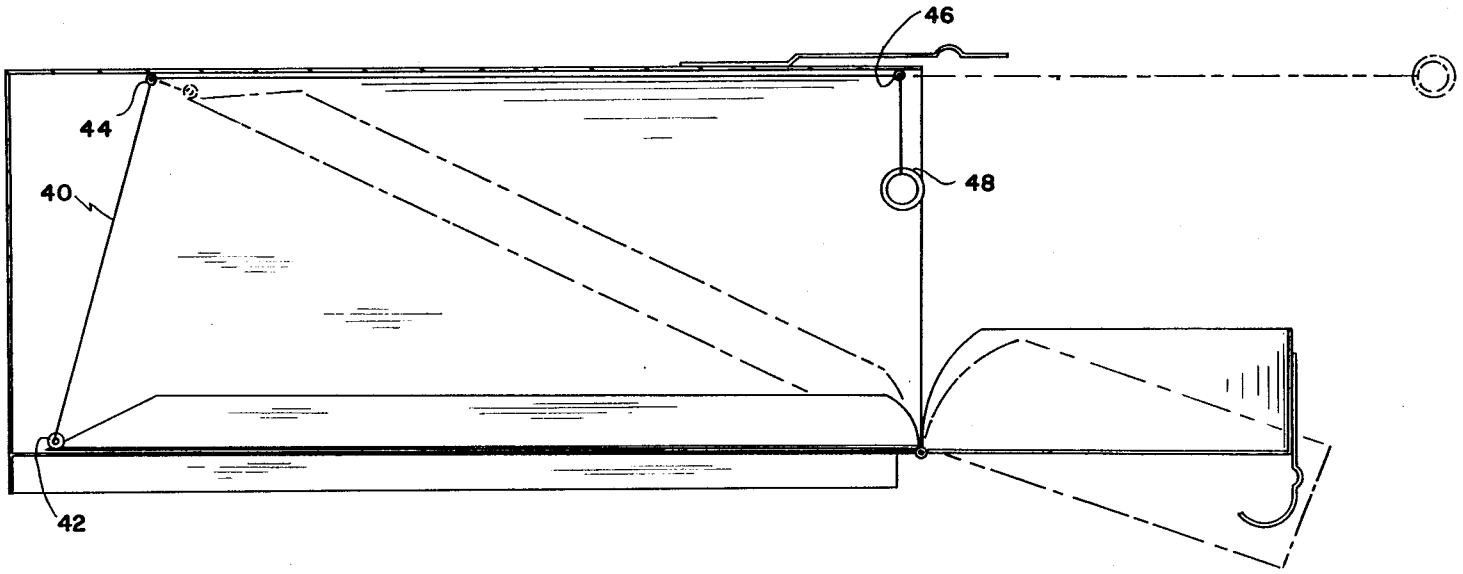
FIG. 3 is a cut-away view of another embodiment of a tiltable tray with alternate means for effecting tilting.

FIG. 3 shows an embodiment wherein a string pull is provided for lifting the back of the tray from a horizontal position to the tilted position shown in dotted lines. A string 40 is secured through an aperture 42 at the rear of the tray and is threaded through a pulley 44 fastened to the top of the box toward the rear end and pulley 46 at the top near the front, the end of the string at the front being connected to a ring 48 for being pulled. This arrangement allows the tray to be lifted without being pried upward by force applied to the hinge. The hinge would still include a motion-limiting feature to prevent the mail-containing container from extending downward past the location shown in dotted lines.

Figure 4:
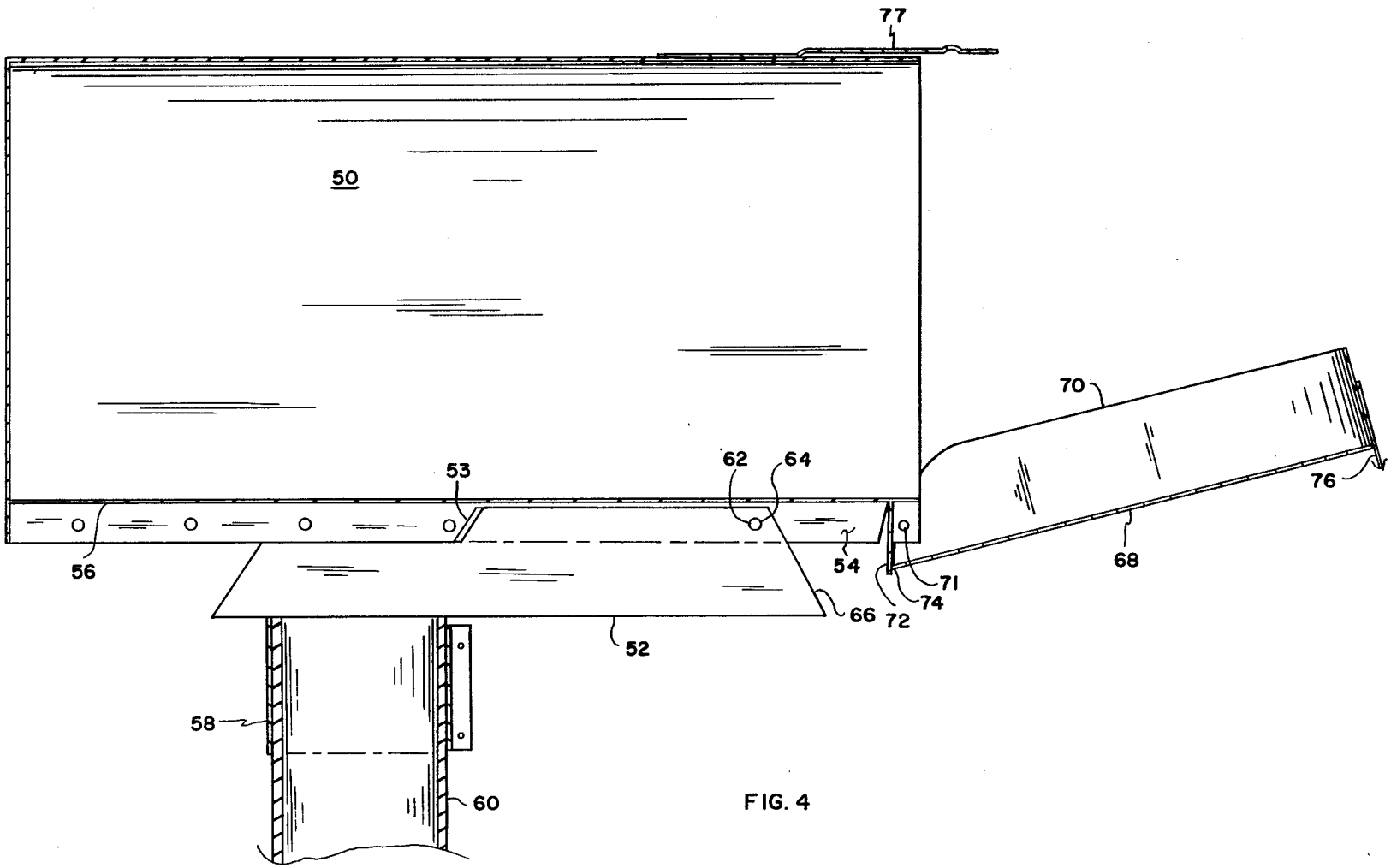
FIG. 4 is a cut-away view of a tiltable mailbox shown in untilted position.
Figure 5:
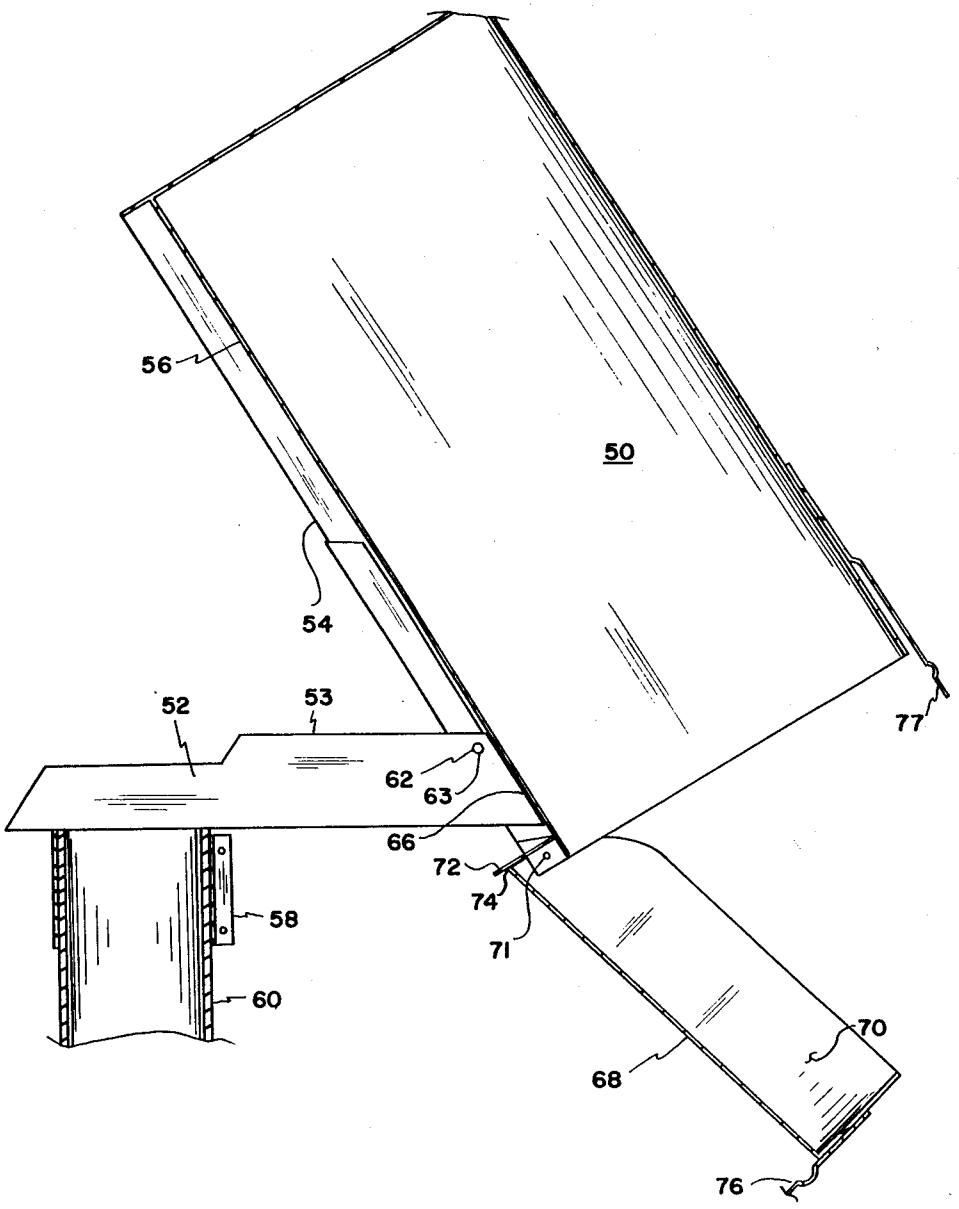
FIG. 5 is a cut-away view of the mailbox of FIG. 4 shown in tilted position.
Figure 6:
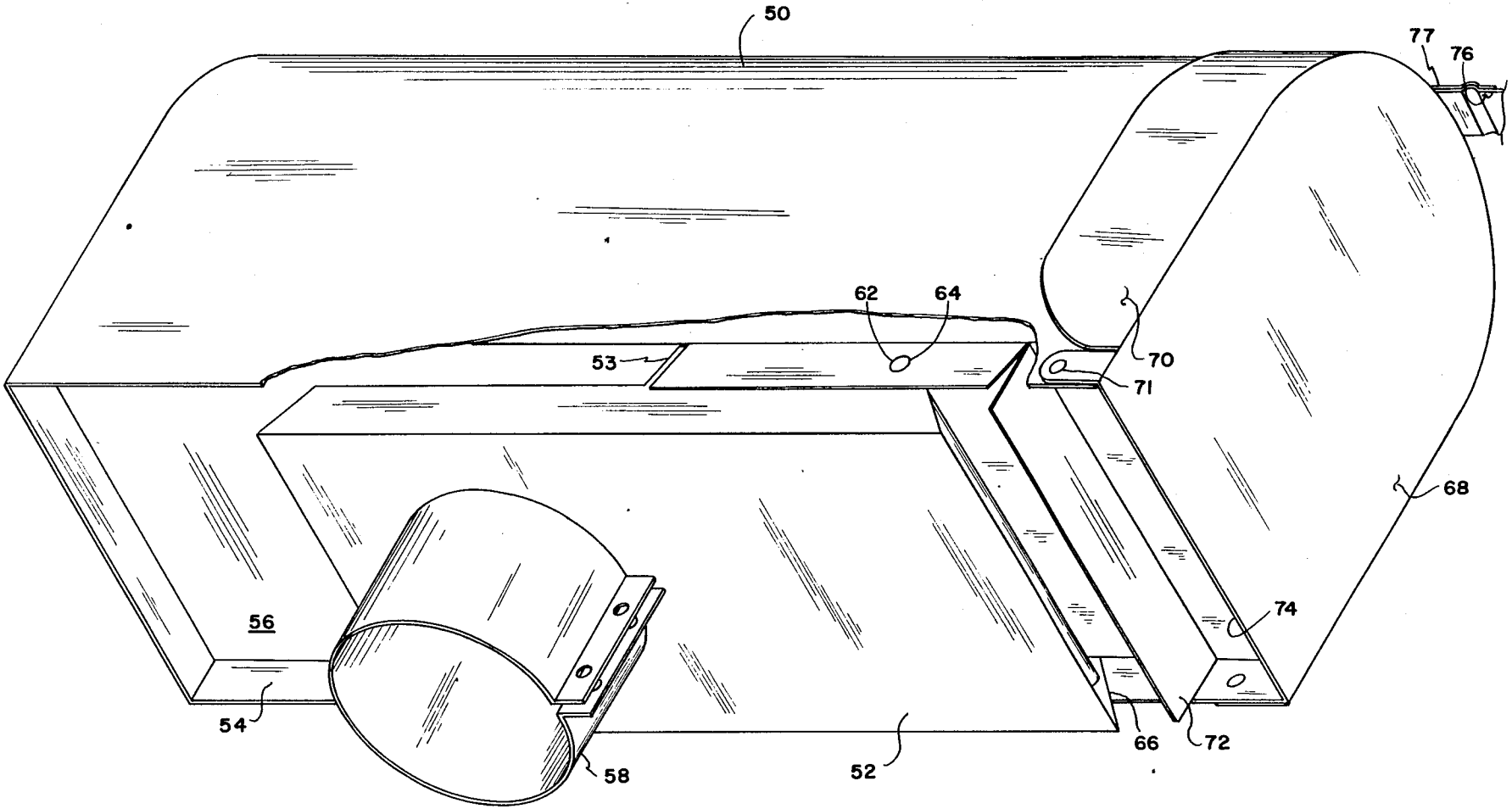
FIG. 6 is a pictorial view taken from below showing further details of the mailbox of FIGS. 4 and 5.

FIGS. 4, 5, and 6 show an embodiment wherein the tiltable mail-holding surface is the bottom panel of a conventionally constructed mailbox, and mechanisms are provided for tilting the entire box forward and down to cause mail to be projected by gravity into a mail-catching container. The mailbox 50 is mounted to rest on a platform 52, the platform fitting within flanges 54 of the bottom panel 56 and having a flat upper surface on which the bottom panels rests and upward extending side portions 53.

A clamp support 58 rigidly secures the platform to a post 60. A pivot pin 62 extends transversely through apertures 63 near the top of the front edges of the platform and through mating aperture 64 in flange portions of the bottom panel of the mailbox. The box is thus supported to be pivoted downward and forward around the axis of pivot pin 62 to the deployed position shown in FIG. 5. Pivot pin 62 is located in a position such that the bottom of the box may be brought down into contact with beveled front edges 66 of the platform sides 53. Door 68 of the mailbox has a wall 70 extending perpendicular to its edges, the wall and back side of the door defining a mail-catching container. The door is rotatable downward and around pin 71 and is restrained from downward movement past the location shown in FIG. 5 by means of front flange 72 of the bottom panel coming into contact with the bottom edge 74 of the door. A grasping handle 76, which may be an enlarged pull that mates with a resilient catch 77 releasably securing the door, enables the box to be pulled into tilted position.

While the invention is described above in terms of specific embodiments, it is not to be understood as limited thereto but is limited only as indicated by the following claims.

I claim:

1. In combination:

a rural mailbox including means defining a normally horizontally disposed, substantially planar mail-receiving surface having a front edge and a rear edge, a back panel, and a U-shaped roof portion defining an enclosure opening at the front end thereof and a door pivotally mounted adjacent said entrance opening for movement between an open position permitting access to the enclosure and a closed position covering the entrance opening;

means for tilting said planar surface so that the rear edge thereof will be higher than its front edge, and mail located thereon will slide forward and down, outwardly from the enclosure; and mail-catching means associated with said door and disposed for receiving and retaining outwardly sliding mail when said door is in the open position.

2. The combination as defined in claim 1 wherein said mail-catching means comprises a wall disposed around the periphery of said door perpendicular to the plane of the door and on the inside thereof.

3. A mailbox assembly comprising:

a rural mailbox having a bottom panel, a back panel, and a U-shaped roof portion defining an enclosure with an entrance opening at one end thereof and a door pivotally mounted adjacent said entrance opening for movement between an open position, permitting access to the enclosure, and a closed position covering the entrance opening;

stationary post means;

platform means rigidly secured to said post means and adapted to support said mailbox for pivotal movement from a horizontal position to a tilted position wherein the entrance opening of the mailbox is lower than the back panel thereof to an extent such that mail located therein will slide forward and outwardly when the door is opened;

means for tilting said mailbox; and mail-catching means associated with said door for receiving and retaining mail that is slid forward and outward.

4. A mailbox assembly as defined in claim 3 wherein said platform means comprises a generally rectangular frame shaped to fit within downward-extending flanges of the bottom panel of the mailbox, the frame including an upper surface disposed to receive and support the bottom panel in horizontal position and side members supporting transverse pivot means engaging said flanges so as to enable the mailbox to be tilted forward and downward around the transverse pivot means.

5. A mailbox assembly as defined in claim 4 wherein said mail catching means comprises a wall disposed around the periphery of said door perpendicular to the door and on the inside thereof.

6. A mailbox assembly as defined in claim 5 including stop means for limiting the tilting movement of said mailbox.

7. A mailbox assembly as defined in claim 6 wherein said stop means comprises a beveled forward edge of said frame disposed to engage said bottom panel near the forward end thereof.

8. A mailbox assembly as defined in claim 7 including stop means for limiting the downward movement of said door when in the open position.

9. Apparatus enabling retrieval of mail from a rural mailbox having a bottom panel, a back panel, and a U-shaped roof portion defining an enclosure with an entrance opening at one end thereof and a door pivotally mounted adjacent said entrance opening for movement between an open position, permitting access to the enclosure, and a closed position covering the entrance opening comprising:

a tray insert conforming to said bottom panel and having its forward end pivotally mounted for movement around the same axis as said door, whereby its rearward end may be tilted upward so as to cause mail supported thereon to slide forward and outward;

means for tilting said tray; and mail-catching means associated with said door for receiving and retaining mail that slides from the tray.

10. Apparatus as defined in claim 9 wherein said tray is generally rectangular and has upward-extending flanges on its longer sides to prevent mail therein from becoming lodged.

11. Apparatus as defined in claim 9 wherein said mail-catching means comprises a wall disposed around the periphery of said door perpendicular to the plane of the door and on its inside.

12. Apparatus as defined in claim 11 including stop means for limiting forward movement of said door relative to said tray.

13. Apparatus as defined in claim 11 wherein said tray and said door are mounted on opposing sides of a limited-motion hinge pivotally secured to a lower front portion of the mailbox.

14. Apparatus as defined in claim 13 wherein said means for pivoting said tray comprises a handle on the outside and at the top of the door.

15. Apparatus as defined in claim 13 wherein said means for pivoting said tray comprises a flexible pull cord having one end secured to the rearward end of the tray, pulley means at the top of the box for supporting the cord in graspable position at the front thereof, and a pull member secured to the other end of the cord.

* * * * *